313-422 SR
4/6/82 DR 4,323,815

United States Patent [19]
Russell

[11] 4,323,815
[45] Apr. 6, 1982

[54] UNITARY BEAM GUIDE/ELECTRON GUN ASSEMBLY FOR FLAT PANEL DISPLAY DEVICES

[75] Inventor: John P. Russell, Pennington, N.J.

[73] Assignee: RCA Corporation, New York, N.Y.

[21] Appl. No.: 125,823

[22] Filed: Feb. 29, 1980

[51] Int. Cl.³ ..... H01J 29/02
[52] U.S. Cl. ..... 313/422; 313/417
[58] Field of Search ..... 313/422, 417

[56] References Cited

U.S. PATENT DOCUMENTS 4,234,815 11/1980 Credelle ..... 313/422

*Primary Examiner*—Eli Lieberman
*Attorney, Agent, or Firm*—Eugene M. Whitacre; Glenn H. Bruestle; Lester L. Hallacher

[57] ABSTRACT

In a flat panel display device a beam guide assembly includes electron guide meshes, a focus mesh and an acceleration mesh, which are retained in a spaced parallel relationship by insulative posts. Modulation electrodes, within an electron gun section of the display device, are extended toward the guide meshes so that the guide meshes and the modulation electrode partially overlap in a spaced parallel relationship. The focus and acceleration meshes are extended toward the gun section to partially overlap the modulation electrodes in a spaced parallel relationship. Insulative posts are arranged along the extended portions to retain the spaced parallel relationships of the electrodes and the meshes. A cathode support is held by the insulative posts and supports a cathode within the gun section in the desired location and orientation with respect to the guide meshes. A unitized beam guide/electron gun assembly is thus achieved.

4 Claims, 5 Drawing Figures

UNITARY BEAM GUIDE/ELECTRON GUN ASSEMBLY FOR FLAT PANEL DISPLAY DEVICES

BACKGROUND OF THE INVENTION

This invention relates generally to flat panel display devices and particularly to a unitary beam guide/electron gun assembly for such devices.

U.S. patent application Ser. No. 116,251 filed Jan. 28, 1980 by Charles B. Carroll entitled "Baseplate Assembly For Flat Panel Display Devices" discloses a flat panel display device including an electron gun section having a line cathode and a modulator. The display device includes a display section which is divided into a plurality of channels along which electron beams are propagated. A display screen is arranged along one inside surface of the display section and when a particular line of the visual display is to be generated, electron beams propagating in the channels are deflected to strike the display screen. Accordingly, each of the channels contributes a portion of each of the lines across the display screen.

Each of the channels includes a beam guide assembly having a pair of spaced parallel guide meshes, a focus mesh and an acceleration mesh which are in a spaced parallel relationship with respect to the guide meshes. The electron gun section includes a modulator support, having a plurality of retention recesses which receive retention tabs integral with the beam guide assemblies. The line cathode within the electron gun section is precisely positioned with respect to the modulator support and the beam guide assemblies so that electrons from the cathode enter the spaces between the guide meshes for propagation along the channels.

In Assemblying the Carroll display device, the modulator support is precisely located with respect to one inside surface of the display section. The line cathode is then located with respect to the modulator support. The beam guide assemblies are attached to the modulator support by mating the retention tabs and the retention recesses. The retention recesses are precisely located along the modulator and, therefore, the beam guide assemblies are precisely located with respect to the modulator support. Accordingly, the beam guide assemblies and the cathode are positioned with respect to one another because they both are referenced to the modulator support.

SUMMARY OF THE INVENTION

In a flat panel display device, electrons propagate along a plurality of channels. Guide meshes within the channels are arranged in a spaced parallel relationship to form spaces to receive the electrons from an electron source. The guide meshes and modulation means for modulating the electrons partially overlap in a spaced parallel relationship. The modulation means and at least one additional electrode also partially overlap in a spaced parallel relationship. A support means holds the electron source along the plane of the center of the space between the guide meshes. Insulative spacers maintain the desired relationships of the guide meshes, the modulation means, the electrodes and the support to form a unitary assembly.

DETAILED DESCRIPTION OF THE PREFERRED EMBODIMENT

Figure 1:
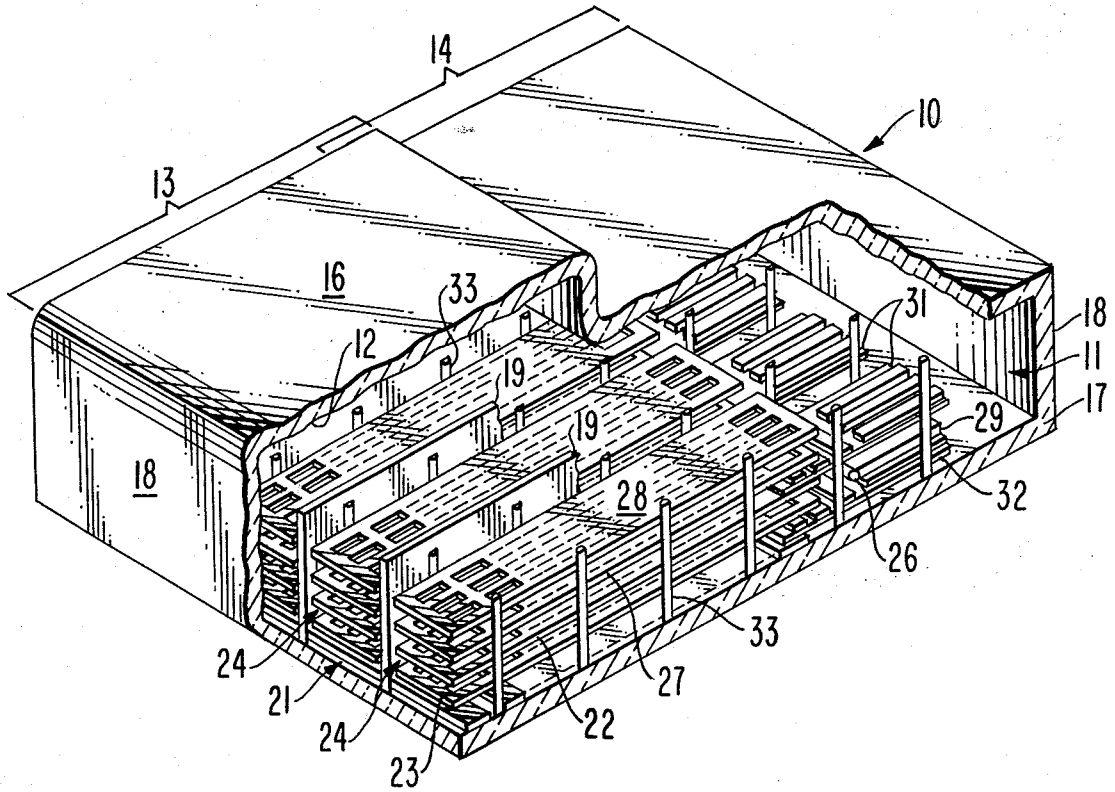
FIG. 1 is a simplified perspective view, partially broken away, showing the major components of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a frontwall 16 and a baseplate 17 held in a spaced parallel relationship by four sidewalls 18. A display screen 12 is positioned along the frontwall 16 and gives a visual output when struck by electrons.

A plurality of spaced parallel support vanes 19 are positioned between the frontwall 16 and the baseplate 17. The support vanes 19 provide the desired internal support against external atmospheric pressure and divide the envelope 11 into a plurality of channels 21. A beam guide assembly, including spaced parallel beam guide meshes 22 and 23, a focus mesh 27, and an acceleration mesh 28 extends transversely across and longitudinally along each of the channels 21. A line cathode 26 is supported by a cathode support 29 and is arranged to emit electrons into the spaces 24 between the guide meshes in each channel 21 so that the electrons propagate the lengths of the channels. A pair of modulation supports 31 and 32 are arranged in a spaced parallel relationship and extend from the gun section 14 toward the beam guide assembly to partially overlap the guide meshes 22 and 23. The cathode 26 is centered between the modulation supports 31 and 32. The meshes, 22, 23, 27 and 28, the cathode support 29 and the modulation supports 31 and 32 are retained in the desired mutually spaced parallel relationships and orientations by a plurality of insulative spacers, or beads 33, which secure them together into a unitary subassembly.

Figure 2:
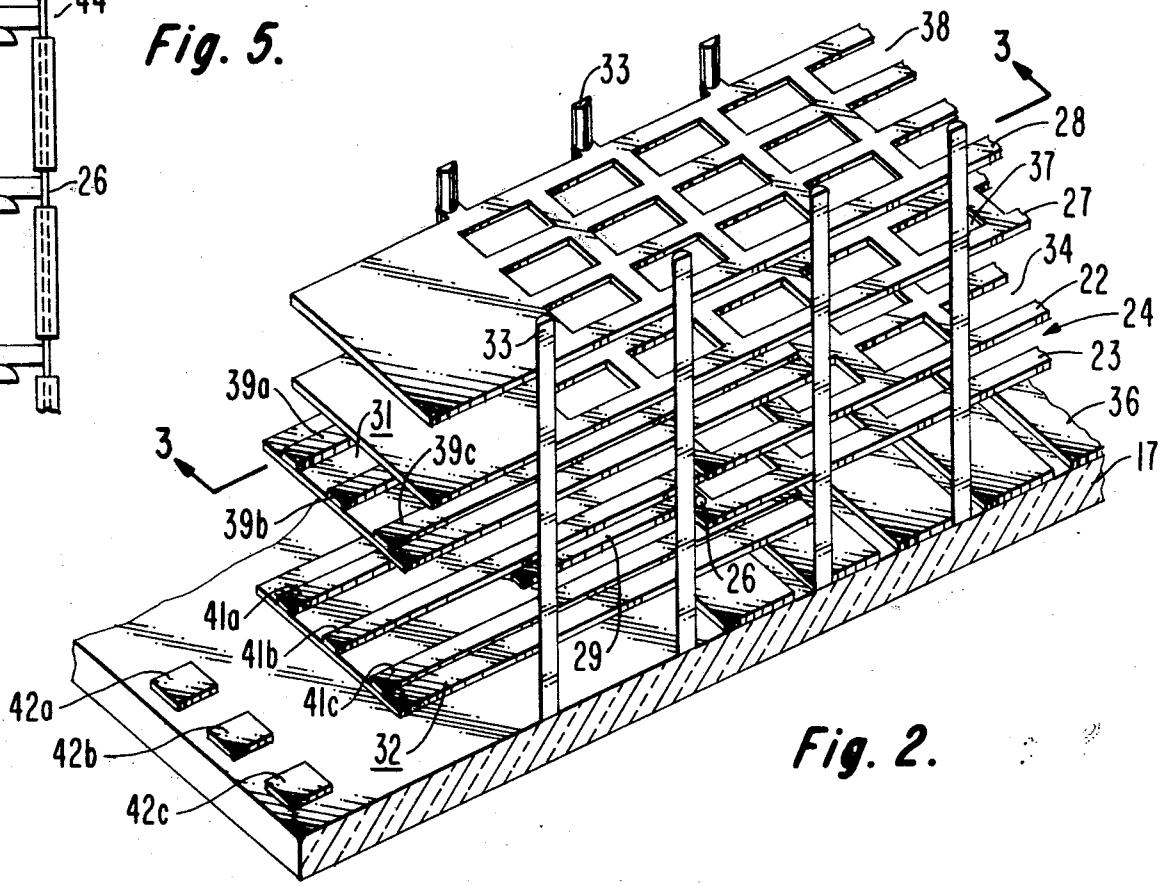
FIG. 2 is a perspective view, partially broken away, of a preferred embodiment.

FIG. 2 shows the preferred embodiment of FIG. 1 with the frontwall 16 and the sidewalls 18 removed. The beam guide meshes 22 and 23 contain apertures 34 which are arranged in columns longitudinally along the meshes and in rows transverseley across the meshes. Extraction electrodes 36 are arranged along the inside surface of the baseplate 17 and extend across the entire transverse dimension of the baseplate. Each extraction electrode 36 is aligned with one of the transverse rows of apertures 34 so that the energization of one extraction electrode results in the generation of one line of the display.

The focus mesh 27 is adjacently spaced from and parallel to the upper guide mesh 22, and the acceleration mesh 28 is adjacently spaced from and parallel to the focus mesh 27 on the side thereof opposite the guide mesh 22. The focus mesh and the acceleration mesh, respectively, contain apertures 37 and 38, which are aligned with the apertures 34 within the guide meshes 22 and 23. The transverse rows of apertures in the meshes 22, 27 and 28 are slightly displaced longitudinally so that the rows of apertures lie along curved paths followed by the electrons when they are ejected from the spaces 24.

The cathode 26 is positioned to emit electrons into the spaces 24 between the guide meshes 22 and 23 of all the channels 21. The line cathode 26, therefore, provides the electrons for all of the channels. Additionally, one complete line of the visual display is generated by the passage of electrons through the same transverse row of apertures 34 in all the guide mesh pairs. Accordingly, it is essential that the guide mesh assemblies of all of the channels 21 be properly aligned with respect to the cathode 26. This is accomplished by combining the beam guide section and electron gun section for each channel into a unitary assembly.

Figure 3:
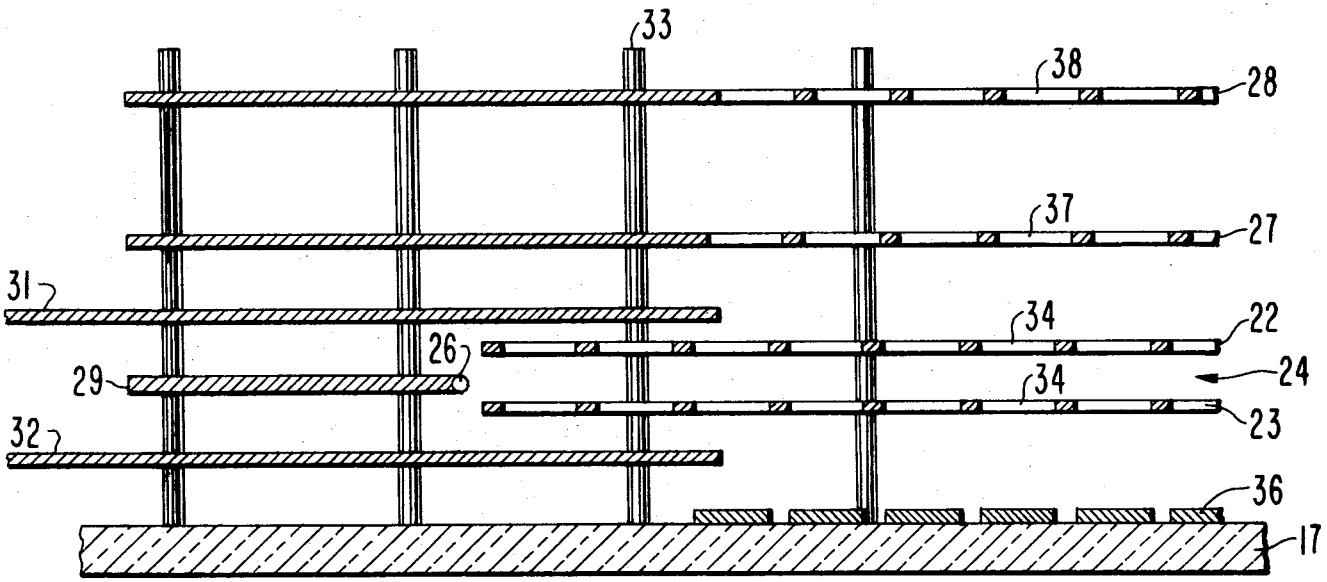
FIG. 3 is a cross section taken along line 3—3 of FIG. 2.

As shown in FIG. 3 the guide meshes 22 and 23, the focus mesh 27 and the acceleration mesh 28 are held in a spaced parallel relationship by a plurality of the insulative spacers or beads 33. The spacing between the meshes must be permanently maintained and accordingly the beads 33 are permanently affixed to the edges of the meshes. The beads 33 typically are made of a formable glass, such as type 7761 available from Corning Glass Co., which becomes malleable when heated. Accordingly, the meshes can be held in the desired spacing and orientation by a fixture of convenient type and the glass beads 33 heated and impaled onto tabs or claws on the sides of the meshes. Upon cooling, the beads shrink to bring the spacing of the meshes to the precise desired distances and the beads harden to permanently hold the meshes in the desired spacings and relationships.

The modulation supports 31 and 32 also are held in the desired spaced relationship by the beads 33. The modulation supports 31 and 32 lie on different sides of the cathode 26 so that the cathode is centered between the supports. The modulation supports extend toward the beam guide assembly to partially overlap the guide meshes so that modulation electrodes can overlap the guide meshes as described hereinafter.

The cathode 26 is supported in the same plane as the center of the space 24 between the guide meshes 22 and 23 by the cathode support 29, which also is retained in the desired position by the beads 33.

Figure 4:
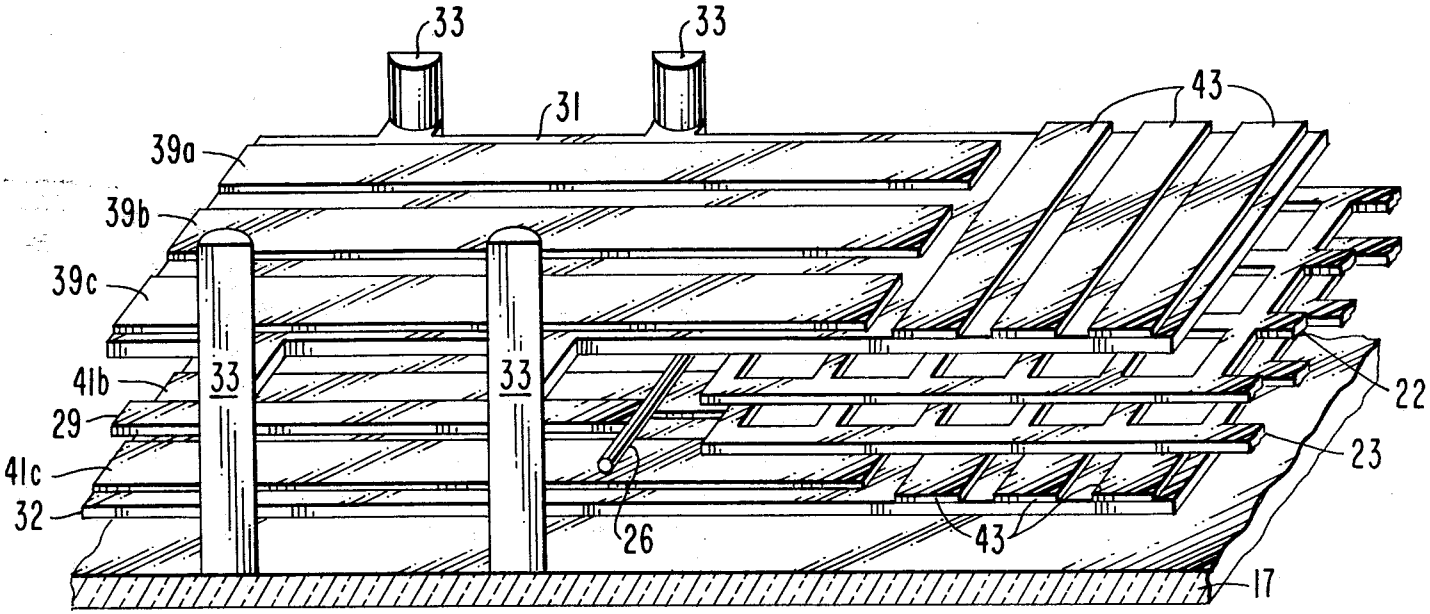
FIG. 4 is a perspective view, with the focus mesh and the acceleration mesh removed to more clearly show a preferred embodiment of a cathode support.

As shown in FIGS. 2 and 4, the modulation support 31 consists of an insulative material, such as ceramic, having a plurality of modulation electrodes 39*a*, 39*b* and 39*c* deposited thereon, or otherwise permanently affixed thereto. Each of the electrodes 39*a*, 39*b* and 39*c* is longitudinally aligned with one of the columns of apertures 34 in the guide meshes 22 and 23. The modulation support 32 also consists of a ceramic base having a plurality of modulation electrodes 41*a*, 41*b* and 41*c* aligned with the columns of apertures 34 in the guide meshes 22 and 23. The two modulation electrodes, e.g., 39*c* and 41*c*, which are aligned with the same column of apertures are electrically connected together into a pair of modulation electrodes in order to modulate the electrons prior to entering the spaces 24. The electrical connection of the two sets of modulation electrodes 39*a*, 39*b*, 39*c*, and 41*a*, 41*b*, and 41*c* into pairs is accomplished with conductive pads 42*a*, 42*b* and 42*c*, which are permanently affixed to the inside surface of the baseplate 17. Flexible conductive members, such as braided wires (not shown), are extended from the modulation electrodes 39*a* and 41*a* to the pad 42*a*. Similar connections are made from the remaining modulation electrodes to the pads 42*b* and 42*c*. The desired modulating voltages are then applied to the modulation electrodes pairs by outside circuitry connected to the pads 42*a*, 42*b* and 42*c*. If desired, isolation electrodes can be arranged parallel to both sides of the modulation electrodes. The isolation electrodes would be biased with a fixed potential so that the modulation voltages on adjacent modulation electrodes would not interfere with each other.

The modulation electrodes are extended toward the guide meshes to overlap the meshes. The cathode 26 is centered between the modulation electrodes and is aligned with the plane of the center of the space 24. Accordingly, the guide meshes 22 and 23 also are centered between the modulation electrodes. The overlap of the modulation electrodes and the guide meshes terminates before the first row of apertures 34. This overlap shields the entrance of the space 24 from field fringe effects of the biasing voltages on the focus and acceleration meshes and the extraction electrodes 36. The modulation and isolation electrodes which are supported by the support 32 can be applied to the baseplate 17 and the support 32 eliminated. The guide meshes 22, 23 and the cathode 26 then are centered between the modulator support 31 and the baseplate 17.

As shown in FIG. 4, the modulator supports 31 and 32 also can be used to support electron injection electrodes 43 which are used to form an input section. Such a section enhances the injection of electrons into the spaces 24 between the guide meshes 22 and 23. When an input section is used, the injection electrodes 43, which form the input section are arranged perpendicular to the modulation electrodes and extend the entire transverse dimension of the beam guide/electron gun assembly in the same plane as the modulation electrodes. The injection electrodes on the two supports 31 and 32 are arranged in pairs and are aligned so that each pair spans one of the transverse rows of apertures in the guide meshes 22 and 23. Biasing potentials are applied to the injection electrodes to improve the injection of electrons into the space 24 between the guide meshes in the manner described in application Ser. No. 87,451 entitled "Modulator With Variable Launch Conditions For Multi-Electron Gun Display Devices" filed Oct. 22, 1979 by Wieslaw W. Siekanowicz et al, now U.S. Pat. No. 4,263,529.

Figure 5:
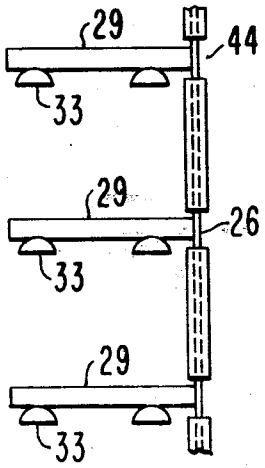
FIG. 5 is a simplified showing of a preferred embodiment of a cathode support.

FIG. 5 shows the cathode support 29 of three adjacent beam guide/electron gun assemblies supporting the cathode 26. The three supports 29 are made from a nonconductive material, such as ceramic, and extend between adjacent beads 33 of the individual beam guide/electron gun assemblies. Thus, each assembly includes one of the cathode supports. The ceramic strips have a width which gives them the desired mechanical strength. The cathode 26 is supported by the cathode supports at every channel of the display device. The cathode 26 can be coupled to the ceramic strips 29 by omitting the electron emissive material at points 44 along the cathode length where coupling to the ceramic strips is required. Typically, the cathode 26 will be made of tungsten coated with an electron emissive material. The bare tungsten base can be bonded to the ceramic supports strips in any of several well known techniques. Because the cathode is supported at points along the entire length, vibration problems ordinarily associated with line cathodes are substantially reduced or eliminated.

The unitary beam guide/electron gun assembly is constructed from elements which are readily fabricated using mass assembly techniques and the elements can be assembled using automatic assembly equipment and techniques. Accordingly, the assemblies can be precisely and rapidly manufactured. The completed assemblies are accurately placed on the baseplate 17 using reference notches in a manner described in the above-referenced application Ser. No. 116,251.

What is claimed is:

1. In a flat panel display device including a beam guide along which electrons propagate as beams, a cathode, and modulation means for modulating said electrons, a unitary beam guide/electron gun assembly comprising:

at least two guide meshes arranged in a parallel and spaced relationship to form at least one space along which said electrons propagate, at least a portion of said modulation means and a portion of said guide meshes overlapping in a parallel and spaced relationship, said modulation means including insulative modulator supports arranged on opposite sides of and substantially equally spaced from said cathode and modulation electrodes affixed to said supports;

at least one additional electrode parallel to and spaced from said guide meshes and at least a portion of said modulation means;

additional insulative support means for supporting said cathode along the plane of the center of said space; and spacer means for maintaining said beam guides, said modulation supports, said additional insulative support means and said additional electrode in said spaced and parallel relationships, said spacer means being spaced along the length of said beam guide/electron gun assembly.

2. The display device of claim 1 wherein said modulation electrodes extend toward said guide meshes so that said modulation electrodes and said guide meshes partially overlap and wherein there are two of said additional electrodes partially overlapping said modulation electrodes so that one of said modulation electrodes partially lies between said additional electrodes and said guide meshes.

3. The device of claim 2 further including injection electrodes supported by said modulator supports, said injection electrodes being substantially perpendicular to said modulation electrodes and positioned on opposite sides of said guide meshes.

4. The device of claim 2 wherein said device is divided into a plurality of channels, each of said channels including one of said unitary beam guide/electron gun assemblies, and wherein said cathode is a line cathode arranged substantially perpendicular to the longitudinal axis of said channels so that a different portion of said line cathode serves as the cathode for each of said channels.

* * * * *